US006116964A

United States Patent [19]

Goodrich et al.

[11] Patent Number: 6,116,964

[45] Date of Patent: Sep. 12, 2000

[54] HIGH FREQUENCY COMMUNICATIONS CONNECTOR ASSEMBLY WITH CROSSTALK COMPENSATION

[75] Inventors: Robert Ray Goodrich, Indianapolis, Ind.; Amid Ihsan Hashim, Randolph, N.J.

[73] Assignee: Lucent Technologies Inc., Murray Hill, N.J.

[21] Appl. No.: 09/264,506

[22] Filed: Mar. 8, 1999

[51] Int. Cl.[7] ..... H01R 23/02

[52] U.S. Cl. ..... 439/676; 439/941

[58] Field of Search ..... 439/395, 676, 439/660, 344, 941, 418

[56] References Cited

U.S. PATENT DOCUMENTS

| | | | |
|---|---|---|---|
| 5,074,804 | 12/1991 | Pantland et al. . | |
| 5,186,647 | 2/1993 | Denkmann et al. . | |
| 5,525,078 | 6/1996 | Springer . | |
| 5,580,270 | 12/1996 | Pantland et al. . | |
| 5,779,503 | 7/1998 | Tremblay et al. | 439/676 |
| 5,911,602 | 6/1999 | Vaden | 439/676 |
| 5,947,772 | 9/1999 | Arnett et al. | 439/676 |

OTHER PUBLICATIONS

Krone AG, Highband Modular Jack–Plug (5 pages) Photos.

*Primary Examiner*—Khiem Nguyen
*Assistant Examiner*—Son V. Nguyen
*Attorney, Agent, or Firm*—Law Office of Leo Zucker

[57] ABSTRACT

A communications connector assembly capable of meeting proposed Category 6 performance levels with respect to near end crosstalk. The assembly includes a wire board having a front portion, and a number of elongated terminal contact wires with base portions connected at one end to the board, and free end portions for electrically contacting a mating connector. The terminal contact wires extend parallel and co-planar with one another above the front portion of the board, and their free end portions project from the front portion of the board. The free end portions are configured to be deflected resiliently toward the board when the mating connector engages them in a direction parallel to the board. A crosstalk compensating device is associated with at least one of the terminal contact wires at a position where the wires are co-planar with one another.

15 Claims, 13 Drawing Sheets

10
56f
56g
56h
20a
20b
CROSSOVER
74
"A"
"B"
"C"
88
72
18a
17
78
80
14
82
60

HIGH FREQUENCY COMMUNICATIONS CONNECTOR ASSEMBLY WITH CROSSTALK COMPENSATION

BACKGROUND OF THE INVENTION

1. Field of the Invention

This invention relates generally to electrical connectors, and particularly to an electrical communications connector arranged to compensate for crosstalk among conductive signal paths carried through the connector.

2. Discussion of the Known Art

There is a need for a durable, high frequency communications connector that compensates for (i.e., cancels or reduces) crosstalk among signal paths carried by the connector. As broadly defined herein, crosstalk occurs when signals conducted over a first signal path, e.g., a pair of terminal contact wires within a connector, are partly transferred by inductive or capacitive coupling into a second, adjacent signal path (e.g., another pair of terminal contact wires) within the connector. The transferred signals become "crosstalk" in the second signal path, and they act to degrade any signals that are being routed through the second path.

For example, an industry type RJ-45 communications connector has four pairs of terminal wires defining four different signal paths. In typical RJ-45 plug and jack connectors, all four pairs of terminal wires extend closely parallel to one another over the lengths of the connector bodies. Thus, crosstalk may be induced between and among different pairs of terminal wires within the typical RJ-45 plug and jack connectors, particularly when the connectors are mated to one another. The induced crosstalk also becomes stronger as signal frequencies or data rates increase.

Applicable industry standards for rating the extent to which communication connectors exhibit crosstalk, do so in terms of so-called near end crosstalk or "NEXT". Moreover, such ratings are typically specified for a mated pair of connectors, e.g., a type RJ-45 plug and jack combination, using the input terminals of the plug connector as a reference plane.

U.S. Pat. No. 5,186,647 to Denkmann et al. (Feb. 16, 1993), which is assigned to the assignee of the present invention and application, discloses an electrical connector for conducting high frequency signals. The connector has a pair of metallic lead frames mounted flush with a dielectric spring block, with connector terminals formed at opposite ends of the lead frames. The lead frames themselves include flat elongated conductors each of which includes a spring terminal contact wire at one end for contacting a corresponding terminal wire of a mating connector, and an insulation displacing connector terminal at the other end for connection with an outside insulated wire lead. The lead frames are placed over one another on the spring block, and three conductors of one lead frame have cross-over sections configured to overlap corresponding cross-over sections formed in three conductors of the other lead frame. All relevant portions of the mentioned '647 patent are incorporated by reference herein. U.S. Pat. No. 5,580,270 (Dec. 3, 1996) also discloses an electrical plug connector having crossed pairs of contact strips.

It is also known to provide crosstalk compensating circuitry on or within layers of a printed wire board, to which spring terminal contact wires of a communication jack are connected within the jack housing. See U.S. patent application Ser. No. 08/923,741 filed Sep. 29, 1997, and assigned to the assignee of the present invention and application. All relevant portions of the '741 application are incorporated by reference herein.

Communication links using unshielded twisted pairs of copper wire are now expected to support reliably data rates up to not only 100 MHz, or industry standard "Category 5" performance; but up to as much as 250 MHz or proposed "Category 6" performance levels. A so-called "HighBand" jack from Krone AG is claimed to exceed Category 5 requirements. The jack includes a printed wire board, and four pairs of terminal contact wires extending normally to the board surface in a non-coplanar configuration. A center pair of the contact wires cross over one another.

Thus, there is a need for a communications connector whose crosstalk characteristics approach Category 6 levels. Likewise, a jack connector which, when mated with a typical type RJ-45 plug connector, compensates for crosstalk in such a way that the mated connectors meet or surpass Category 6 performance, would be highly desirable.

SUMMARY OF THE INVENTION

According to the invention, a communications connector assembly includes a wire board having a front portion, and a number of elongated terminal contact wires each having a base portion connected at one end to the wire board, and a free end portion opposite the base portion to make electrical contact with a mating connector. The terminal contact wires extend substantially parallel and co-planar with one another above the front portion of the board. The free end portions of the contact wires project from the front portion of the board, and are configured to deflect resiliently toward the board when engaged by the mating connector along a direction substantially parallel to the wire board. A crosstalk compensating device is associated with at least one of the contact wires at a position where the wires are co-planar with one another.

In one embodiment, the wire board of the communications connector assembly is inserted within a jack housing, and an opening in a front surface of the jack housing is dimensioned for receiving the mating plug connector.

For a better understanding of the invention, reference is made to the following description taken in conjunction with the accompanying drawing and the appended claims.

DETAILED DESCRIPTION OF THE INVENTION

Figure 1:
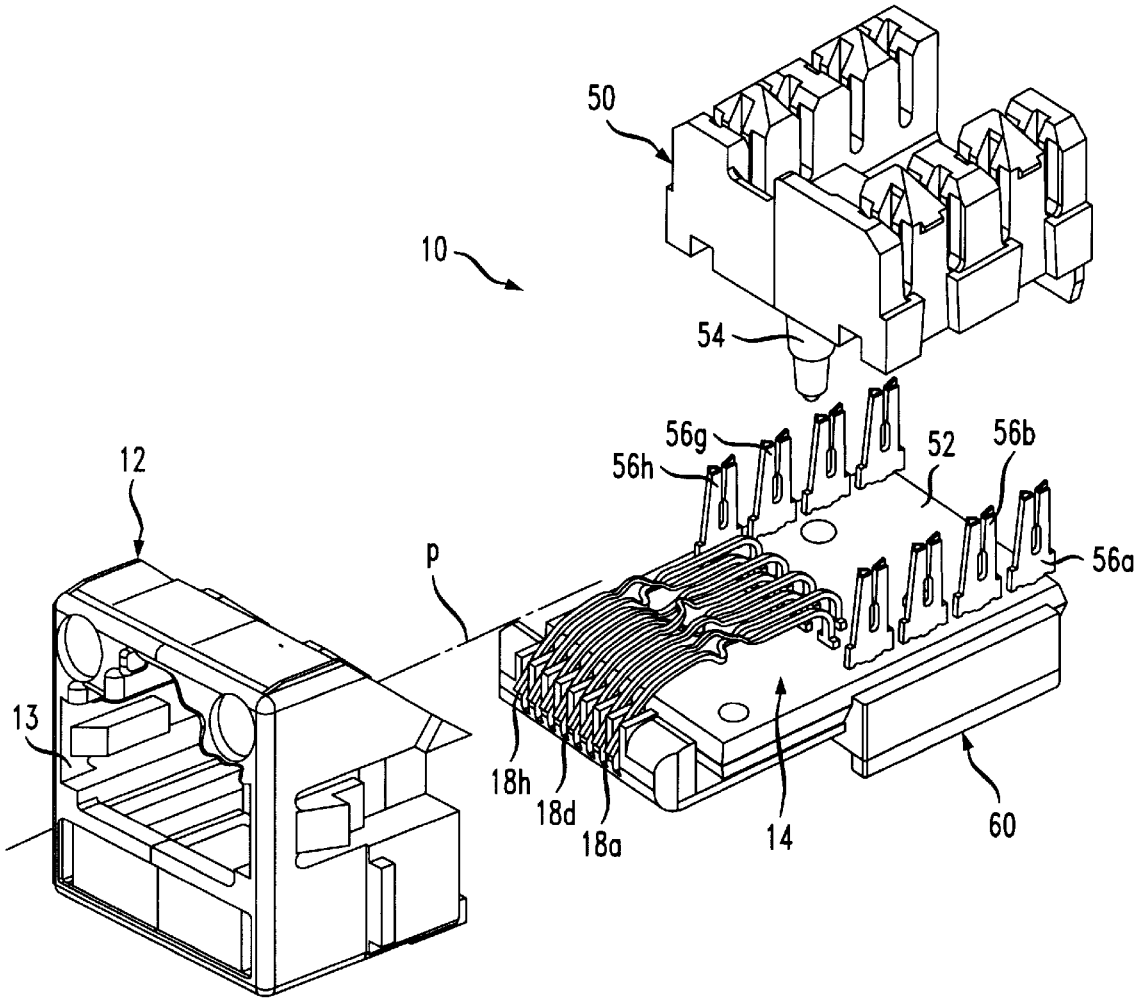
FIG. 1 is a perspective view of a communications connector assembly, and a jack housing into which the assembly can be mounted.
Figure 2:
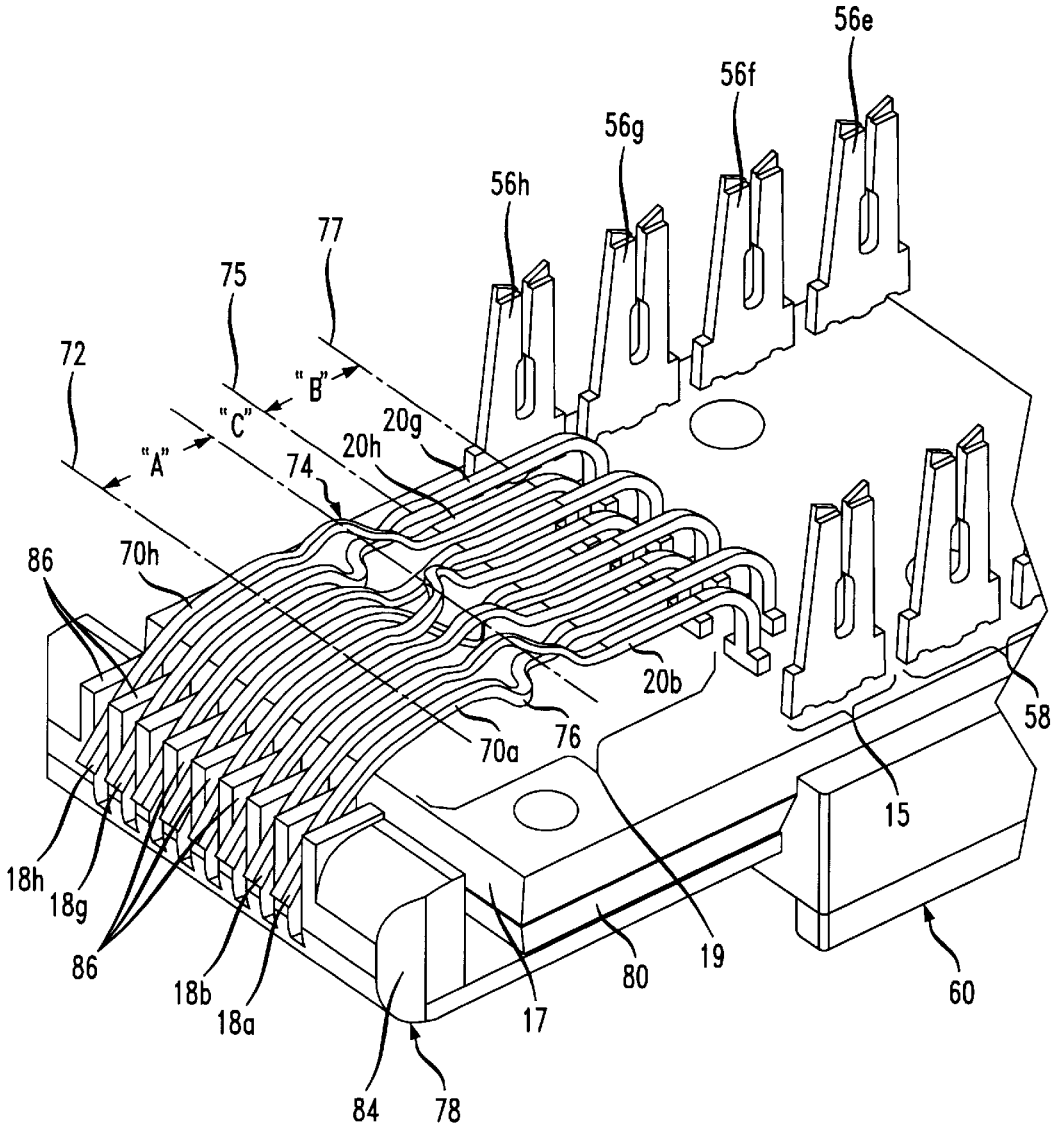
FIG. 2 is an enlarged, perspective view of the communications connector assembly in FIG. 1.

FIG. 1 is a perspective view of a communications connector assembly 10, and a communications jack frame or housing 12 with which the assembly 10 can be associated. The jack housing 12 has a front face in which a plug opening 13 is formed. The plug opening 13 has an axis P, along the direction of which axis a mating plug connector may be inserted in the jack housing 12. FIG. 2 is an enlarged, perspective view of a front portion of the connector assembly 10 in FIG. 1.

In the illustrated embodiment, the communications connector assembly 10 includes a generally rectangular printed wire board 14. The board 14 may comprise, for example, a single or multi-layer dielectric substrate. A number, e.g., eight elongated terminal contact wires 18*a*–18*h* emerge from a central portion 15 of the printed wire board 14, and extend substantially parallel to one another. The contact wires 18*a*–18*h* are generally uniformly spaced a certain distance above a front portion 19 of the wire board 14, and project from the front portion 19. The wires are also configured to deflect resiliently toward the board when engaged by the mating connector in a direction parallel to the wire board.

The material forming the terminal contact wires 18*a*–18*h* may be a copper alloy, e.g., spring-tempered phosphor bronze, beryllium copper, or the like. A typical cross-section of the terminal contact wires 18*a*–18*h* is 0.015 inches square.

The board 14 may incorporate electrical circuit components and devices arranged to compensate for connector-induced crosstalk. Such devices may include wire traces printed within layers of the board, such as are disclosed in the mentioned '741 application. Any crosstalk compensation provided by the board 14 is in addition to, and cooperates with, an initial stage of crosstalk compensation provided by the terminal contact wires 18*a*–18*h*, as explained below.

The terminal contact wires 18*a*–18*h* of the connector assembly 10 have upstanding base portions 20*a*–20*h* that are electrically connected at one end to the central portion 15 of the wire board 14. For example, the ends of the base portions 20*a*–20*h* may be soldered or press-fit in plated terminal openings 22*a*–22*h* in the board 14, for connection with corresponding conductive paths on or within the board. See FIG. 4.

The terminal openings 22*a*–22*h* are formed in the board 14 with staggered offsets in the long direction of the contact wires 18*a*–18*h*. The staggered arrangement of the terminal openings is necessary to maintain a relatively close center-to-center spacing of, e.g., 0.040 inches between adjacent ones of the contact wires. Otherwise, if all the plated terminal openings 22*a*–22*h* were placed in-line, electrical shorting might occur between the platings. Also, an in-line spacing of the eight terminal openings would be too small to permit automated production of the assembly 10. While the offset pattern of the terminal openings shown in FIG. 4 has provided satisfactory test results, which are disclosed below, other patterns of the terminal openings 22*a*–22*h* may also be acceptable. For example, a "saw-tooth" pattern wherein three or more adjacent terminal openings align to define an edge of each tooth, may also offer acceptable performance in certain applications. Accordingly, the offset pattern in FIG. 4 is not to be construed as a limitation in the manufacture of the connector assembly 10, as long as adjacent plated openings are spaced apart enough to prevent electrical shorting.

An electrically insulative or dielectric terminal housing 50 (FIG. 1) covers a wire connection terminal region 52 on top of the wire board 14. Outside insulated wire leads can be connected to board terminals which are only partly surrounded by housing terminal guards. The housing 50 is formed of a plastics or insulative material that meets all applicable standards with respect to electrical insulation and flammability. Such materials include but are not limited to polycarbonate, ABS, and blends thereof. The housing 50 has, for example, a pair of fastening or mounting posts 54 that project from a bottom surface of the housing, as shown in FIG. 1.

Figure 4:
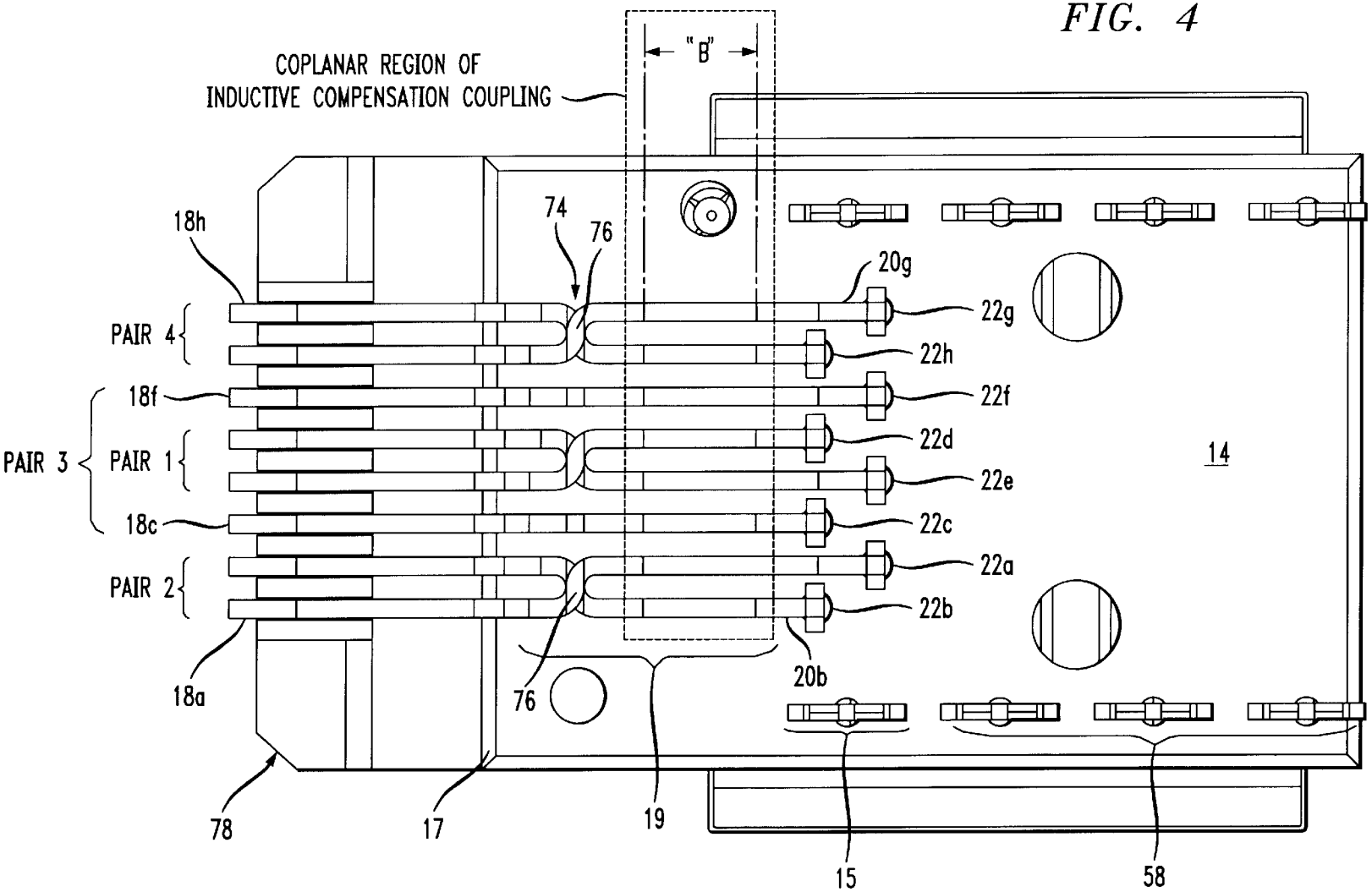
FIG. 4 is plan view of a printed wire board of the assembly, with pairs of connector terminal wires supported on the wire board.

Insulation displacing connector (IDC) terminals 56*a* to 56*h* are mounted at both sides of the central portion 15, and at a rear portion 58 of the wire board 14 as seen in FIGS. 1, 2 and 4. Each of the terminals 56*a*–56*h* connects to a corresponding conductive path (not shown) associated with a different one of the terminal contact wires 18*a*–18*h*. A pair of terminal housing mounting holes are formed in the wire board 14, through which holes the housing fastening posts 54 can pass freely. When the terminal housing 50 is aligned above the IDC terminals 56*a*–56*h* on the wire board 14, and the housing 50 is lowered to receive the IDC terminals in corresponding slots in the terminal guards, the fastening posts 54 align with the mounting holes in the board 14 and pass through them to project below the board.

A cover 60 is made of the same or a similar material as that of the terminal housing 50. The cover 60 is configured to protect the bottom of the wire board 14 at the wire connection terminal region 52. Cover 60 has a pair of openings (not shown) which openings align with tips of the terminal housing fastening posts 54 below the wire board 14, when the terminal housing 50 is lowered to receive the IDC terminals 56*a*–56*h*. The wire board 14 is thus sandwiched or captured between the terminal housing 50 and the cover 60, and the tips of the fastening posts 54 are joined to the body of the cover 60 by, for example, ultrasonic welding which causes the post tips and the surrounding cover body to melt and fuse together. With the wire board 14 thus captured between the terminal housing 50 and the cover 60, the wire connection terminal region 52 on the wire board 14 is protectively enclosed. See co-pending patent application Ser. No. 08/904,391, filed Aug. 1, 1997, and assigned to the assignee of the present invention and application. All relevant portions of the '391 application are incorporated by reference herein.

Figure 3:
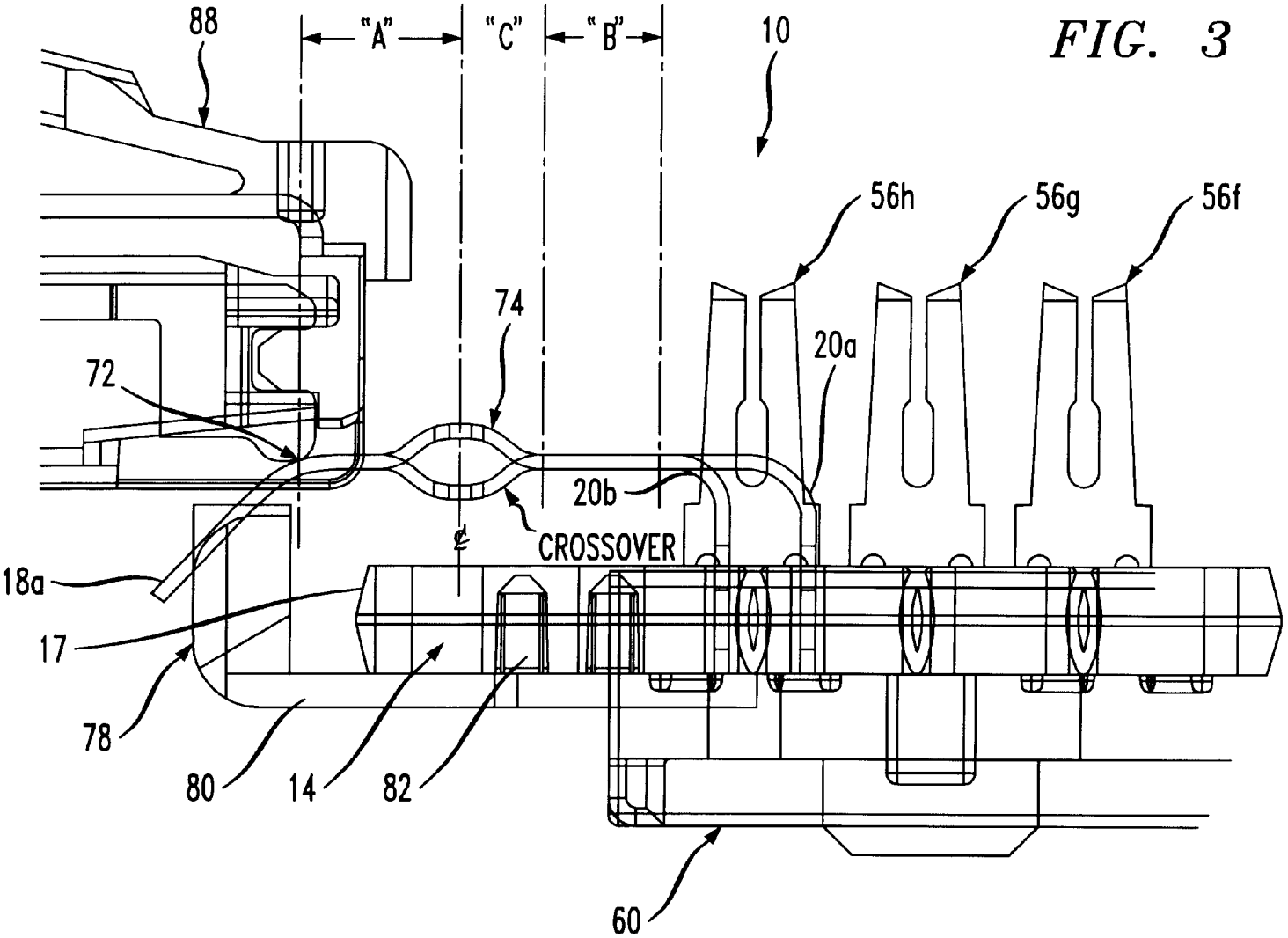
FIG. 3 is a side view, partly in section, showing the connector assembly engaging a mating plug connector inside the jack housing.

The terminal contact wires 18*a*–18*h* have free end portions 70*a*–70*h* opposite the base portions of the contact wires, for making electrical contact with corresponding contact wires of a mating connector 88 (see FIG. 3). The free end portions 70*a*–70*h* have a downwardly arching configuration, and the portions 70*a*–70*h* are supported above and beyond a front edge 17 of the wire board in cantilever fashion by the upstanding base portions 20*a*–20*h* of the terminal contact wires.

The free end portions 70*a*–70*h* of the contact wires 18*a*–18*h* define a line of contact 72 (FIG. 2) transversely of the contact wires, and the wires make electrical contact with a mating connector at points along the line of contact 72. Specifically, when the terminal contact wires 18*a*–18*h* engage a mating connector, the ends of the portions 70*a*–70*h* counter-lever in unison the direction of the board 14, as depicted in FIG. 3. In the following disclosure, the eight terminal contact wires 18*a*–18*h* are sometimes referred to as terminal contact wire pairs. As labeled in FIG. 4, the wire pairs are numbered and identified as follows.

| Pair No. | Contact Wires |
|---|---|
| 1 | 18d, 18e |
| 2 | 18a, 18b |
| 3 | 18c, 18f |
| 4 | 18g, 18h |

As seen in FIG. 4, pairs 1, 2 and 4 of the terminal contact wires have cross-over sections 74, at which each contact wire of the pair is stepped toward and crosses over the other contact wire with a generally "S"-shaped side-wise step 76. The terminal contact wires are also curved arcuately above and below their common plane at each cross-over section 74, as seen in FIGS. 2 and 3. Opposing faces of the steps 76 in the contact wires are spaced apart typically by about 0.035 inches (i.e., enough to prevent shorting when the terminal wires are engaged by a mating connector). Other dimensions concerning the cross-over sections 74 and adjacent portions of the terminal contact wires are set out below in connection with reference to FIGS. 2–4.

| Dimension | Value (Typical) |
|---|---|
| A | 0.149 inches |
| B | 0.108 inches |
| C | 0.072 inches |

In the illustrated embodiment, the cross-over sections 74 are provided on pairs 1, 2 and 4 of the eight terminal contact wires 18*a*–18*h*. The "pair 3" contact wires, i.e., wires 18*c*, 18*f*; straddle contact wire pair 1 (contact wires 18*d*, 18*e*); and no cross-over sections are formed in the "pair 3" contact wires 18*c*, 18*f*. That is, each of the "pair 3" contact wires extends without a side-wise step, and those pairs of terminal contact wires that have the cross-over sections 74 are disposed at either side of a single "pair 3" terminal contact wire 18*c* or 18*f*.

Dimension A is taken from a center line of the cross over sections 74, toward the free end portions 70*a*–70*h* of the terminal contact wires up to the line of contact 72 at which the wires electrically connect with corresponding contact wires of a mating connector. The cross-over sections 74 are thus kept close to the line of contact 72. Accordingly, crosstalk compensation by the connector assembly 10 may start to operate near the line of contact 72, beginning with the cross-over sections 74 whose centers are located, for example, only 0.149 inches from the line of contact 72 in the illustrated embodiment.

Dimensions B and C correspond to portions of the terminal contact wires 18*a*–18*h* that provide inductive crosstalk compensation coupling among the contact wires. Specifically, dimension C is taken from the center line of the cross-over sections 74 in the direction of the base portions 20*a*–20*h* of the contact wires, to a line 75 where the contact wires are again co-planar with one another. Dimension B is taken from the mentioned line 75, to another line 77 where alternate ones of the terminal contact wires bend at their base portions to enter the terminal openings 22*b*, 22*c*, 22*d*, 22*h* in the board 14 (see FIG. 4). The remaining terminal contact wires continue to extend from the line 77 above the board 14, before their base portions enter the terminal openings 22*a*, 22*e*, 22*f*, 22*g*. Those portions of the terminal contact wires corresponding to dimensions B and C thus operate not only to provide an effective initial stage of inductive crosstalk compensation, but also to simplify any additional stages of compensation that may still be required via the printed wire board 14.

FIGS. 1–3 also show a terminal wire guide block 78 having a generally "L"-shaped profile, mounted at the front portion 17 of the board 14. The guide block 78 has a pair of support legs 80, one of which is seen in FIGS. 2 and 3. Each of the legs 80 is held flush against the bottom surface of the wire board 14 by, for example, a ribbed mounting post 82 that is press fit into a corresponding opening in the board 14. See FIG. 3. An elongated guide bar 84 projects upward from the support legs 80, just ahead of the front edge 17 of the wire board 14. The guide bar 84 has evenly-spaced vertical guide ways 86 formed in a forward surface of the bar 84. The free end portions 70*a*–70*h* of the terminal contact wires are received in corresponding ones of the guide ways 86, and the free end portions are separately guided for vertical movement when they are deflected by the action of the mating plug connector 88. See FIG. 3.

Figure 5:
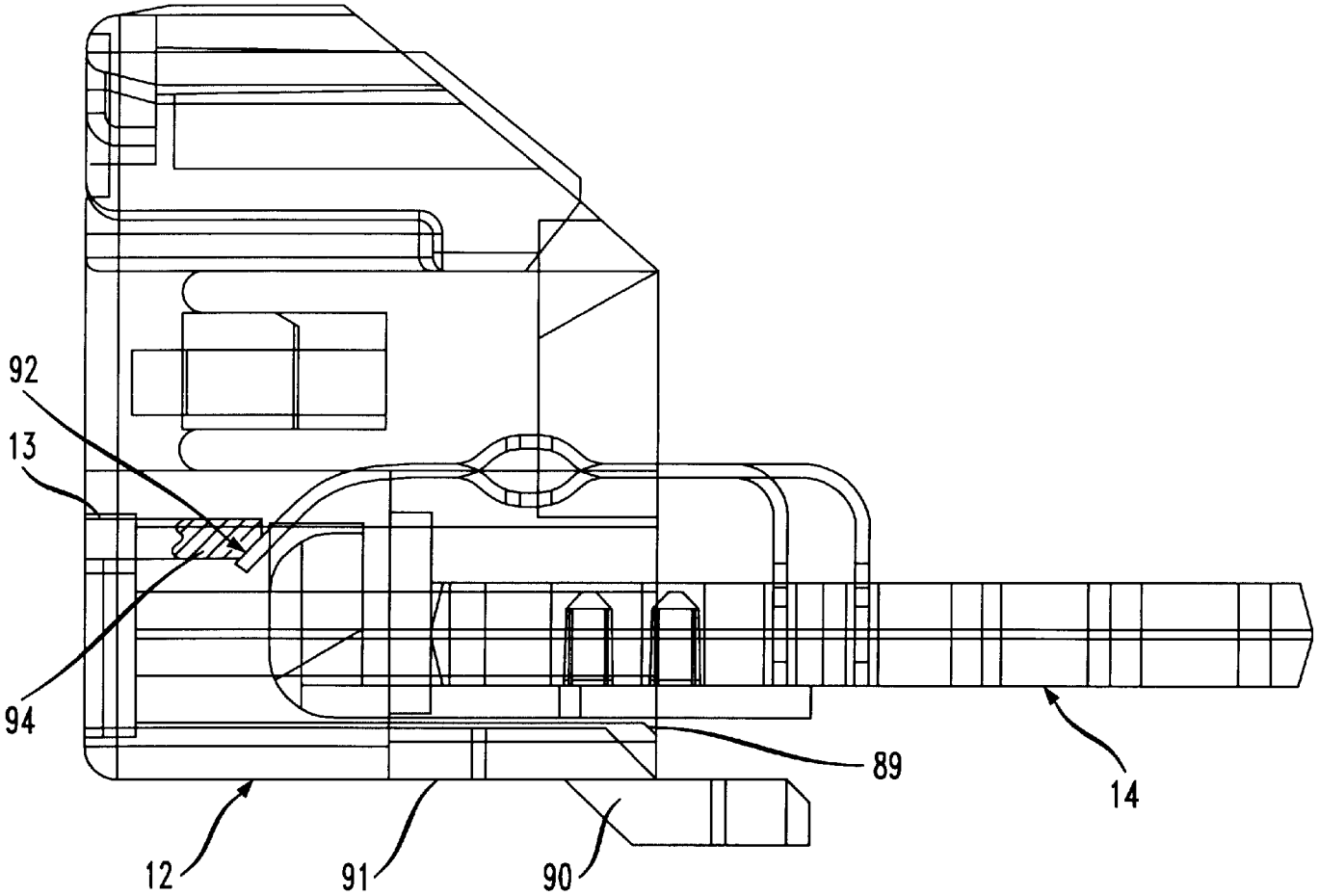
FIG. 5 is a side view, partly in section, showing a terminal wire limit stop in the jack housing.

FIG. 5 is a side view showing the printed wire board 14 of the connector assembly 10 inserted in a passage 89 that opens in the rear surface of the jack housing 12. Side edges of the wire board 14 may be guided for entry into the housing 12 by, e.g., corresponding channel flanges projecting from inside surfaces of the side walls of the jack housing 12. The jack housing 12 has a slotted catch bar 90 protruding horizontally from a bottom wall 91 of the housing. The catch bar 90 is arranged to receive and to hold a flange (not shown) that projects downward from beneath the assembly cover 60, and the assembly 10 is fixed against the rear surface of the jack housing 12. With the assembly 10 thus joined to the jack housing 12, the surface of the front portion 17 of the wire board 14 is parallel to the axis P, i.e., the direction along which the mating plug connector 88 engages and disengages the free end portions 70*a*–70*h* of the terminal contact wires projecting from the front portion 17 of the wire board.

In FIG. 5, before the wire board 14 is inserted in the housing passage 89, the free end portions 70*a*–70*h* of the terminal contact wires are urged downward by conventional means (not shown), so that the wire ends will clear a stop surface 92 formed on a rear edge of a horizontal shelf 94 inside the jack housing 12. The shelf 94 is formed and located so that when the ends of the terminal contact wires are released and abut the stop surface 92, the contact wires are pre-loaded by a determined force prior to engagement with the mating plug connector 88 inside the jack housing 12. This arrangement will ensure that a specified minimum contact force (e.g., 100 grams) is established along the line of contact 72 when the free end portions 70*a*–70*h* of the terminal contact wires are engaged by the mating plug connector 8.

As disclosed above, the connector assembly 10 produces so-called inductive crosstalk among co-planar portions of the terminal wires 18*a*–18*h*, in such a manner as to create an initial stage of what may be a multi-stage crosstalk compensating scheme. This initial stage opposes or compensates for crosstalk introduced when the free end portions 70*a*–70*h* of the terminal contact wires engage corresponding contact wires of the mating plug connector 88, inside the jack housing 12. It may be desirable for the connector assembly 10 also to produce a certain amount of so-called capacitive crosstalk to augment the inductive crosstalk produced by the assembly 10, and to enhance the initial stage of crosstalk compensation.

Figure 6:
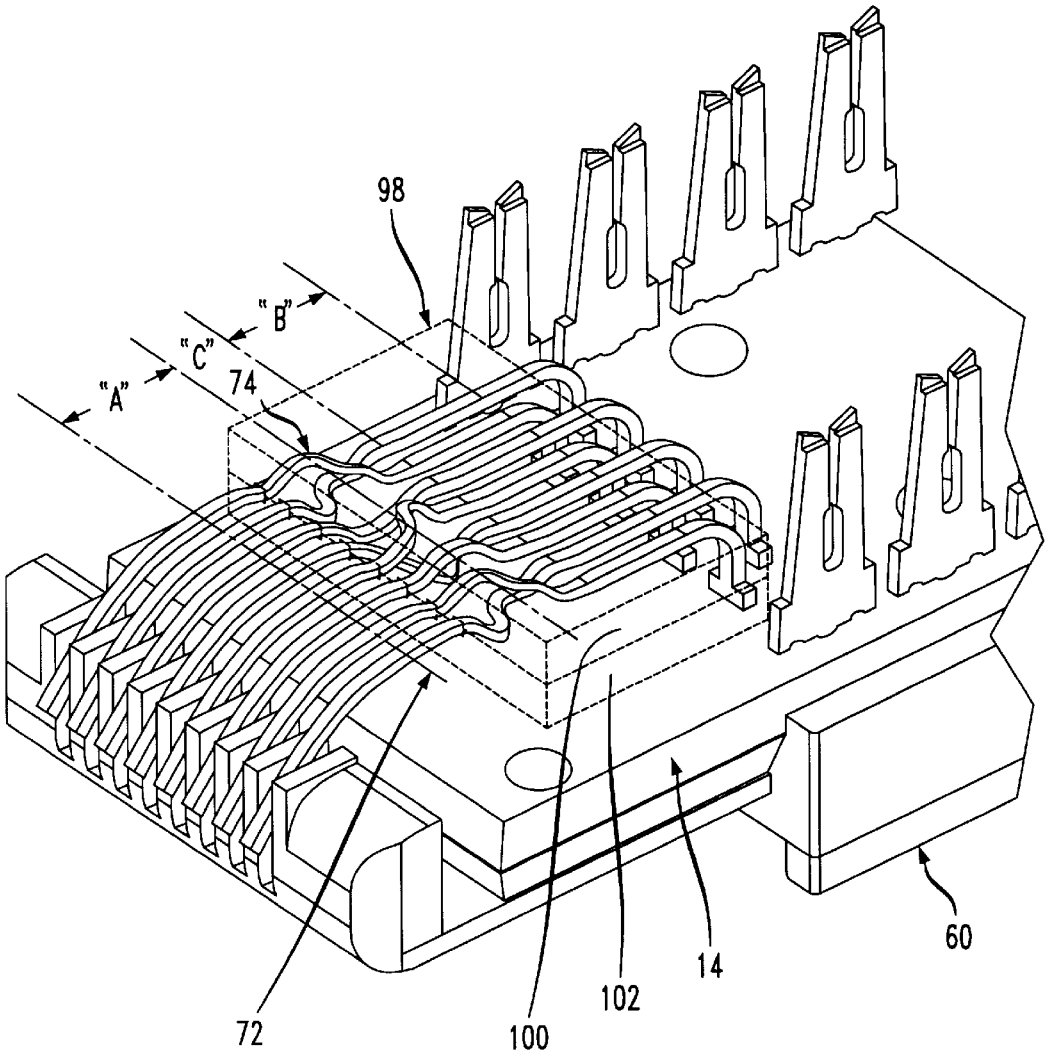
FIG. 6 is a perspective view similar to FIG. 2, showing a dielectric block piece enveloping portions of terminal wires of the connector assembly.
Figure 7:
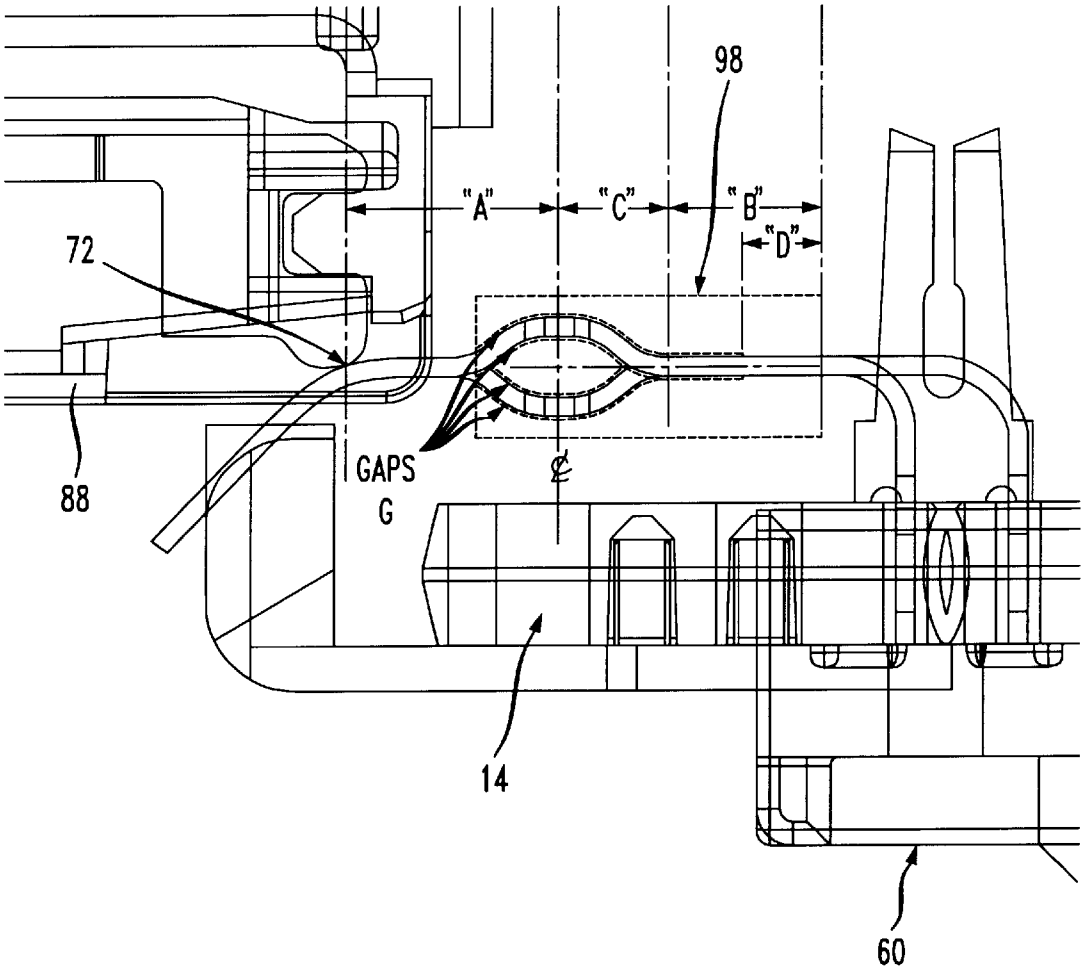
FIG. 7 is side view similar to FIG. 3, showing the dielectric block of FIG. 6 in place on the wire terminals.

As shown in FIGS. 6 and 7, a dielectric or plastics piece 98 at least partly encases the cross-over sections 74, and adjacent portions of the terminal contact wires. The dielectric piece 98 is formed to produce compensating capacitive crosstalk among the terminal contact wires that it envelopes. The piece 98 may, for example, be molded directly around selected portions of the terminal contact wires 18*a*–18*h* as one continuous piece, or as a number of smaller, disjointed pieces. The dielectric piece 98 may also be provided as a separate piece constructed and arranged to be snapped around the terminal contact wires 18*a*–18*h* at positions where the wires are co-planar with one another, as well as in the cross-over sections 74.

The dielectric piece 98 may comprise an upper half block 100 and a lower half block 102. The upper and the lower half blocks 100, 102 may be constructed and arranged to be snapped or ultrasonically welded to one another. In FIG. 7, an arrangement is shown wherein the piece 98 is fitted firmly against the co-planar terminal contact wires over a length D, ahead of the base portions of the contact wires. A small gap G is formed elsewhere between the body of the dielectric piece 98 and the terminal contact wires including the cross-over sections 74, to allow for individual flexure of the wires. By selecting a dielectric or plastics material with specified electrical properties, e.g., a certain dielectric constant, additional electrical performance improvement may be obtained.

The dielectric piece 98 should have an outside configuration that allows it to move or "float" with the terminal contact wires while the latter are deflected by the action of the plug connector 88. In addition to enhanced capacitive crosstalk compensation coupling, the piece 98 maintains a firm alignment at co-planar areas of the terminal contact wires 18*a*–18*h* when the wires are moved, and a constant spacing or gap between opposed steps 76 at the cross-over sections 74 of the wires. The dielectric piece 98 may also offer a greater degree of overall crosstalk compensation, thus lessening the need for any additional stages of compensation on the board 14.

As will be understood from the above, the communication connector assembly 10 is constructed to operate reliably and effectively at frequencies well exceeding 100 MHz, by incorporating the following attributes;

1. Short terminal contact wire lengths to minimize transmission delays, and, thus, to improve the efficiency with which the assembly 10 can compensate for crosstalk.

2. The provision of cross-over sections 74 on selected pairs of the terminal contact wires 18*a*–18*h*. The cross-over sections are disposed near the line of contact 72 between the terminal contact wires and a mating connector. This enables an initial stage of crosstalk compensation to act at a position significantly closer to the line of contact 72, than would otherwise occur if the entire first stage were placed on the wire board 14.

3. A substantially co-planar configuration of the terminal contact wires 18*a*–18*h*, resulting in crosstalk coupling of a kind that opposes crosstalk introduced when the wires contact the mating connector. Such a configuration helps to reduce the number of additional stages required to be placed on or within the printed wire board 14, which usually has only limited space available for such stages.

FIGS. 8–13 show performance data obtained with a network analyzer, and using a prototype wire board having additional stages of capacitive crosstalk compensation per the mentioned '741 application. Values along the horizontal axes correspond to frequency, and results were plotted at frequencies up to 300 Hz. Values along the vertical axes correspond to crosstalk measured at inputs of a given pair of terminals of a communications plug when mated with the connector assembly 10, while a reference signal was applied to the inputs of a different pair of the mating plug terminals. The plug was a type RJ-45, having embedded near end crosstalk (NEXT) previously measured at 100 MHz as follows:

| Terminal Pairs | NEXT (dB) |
|---|---|
| 1 & 2 | −55.2 |
| 1 & 3 | −37.6 |
| 1 & 4 | −66.2 |
| 2 & 3 | −47.6 |
| 3 & 4 | −47.8 |
| 2 & 4 | <−60 |

Figure 8:
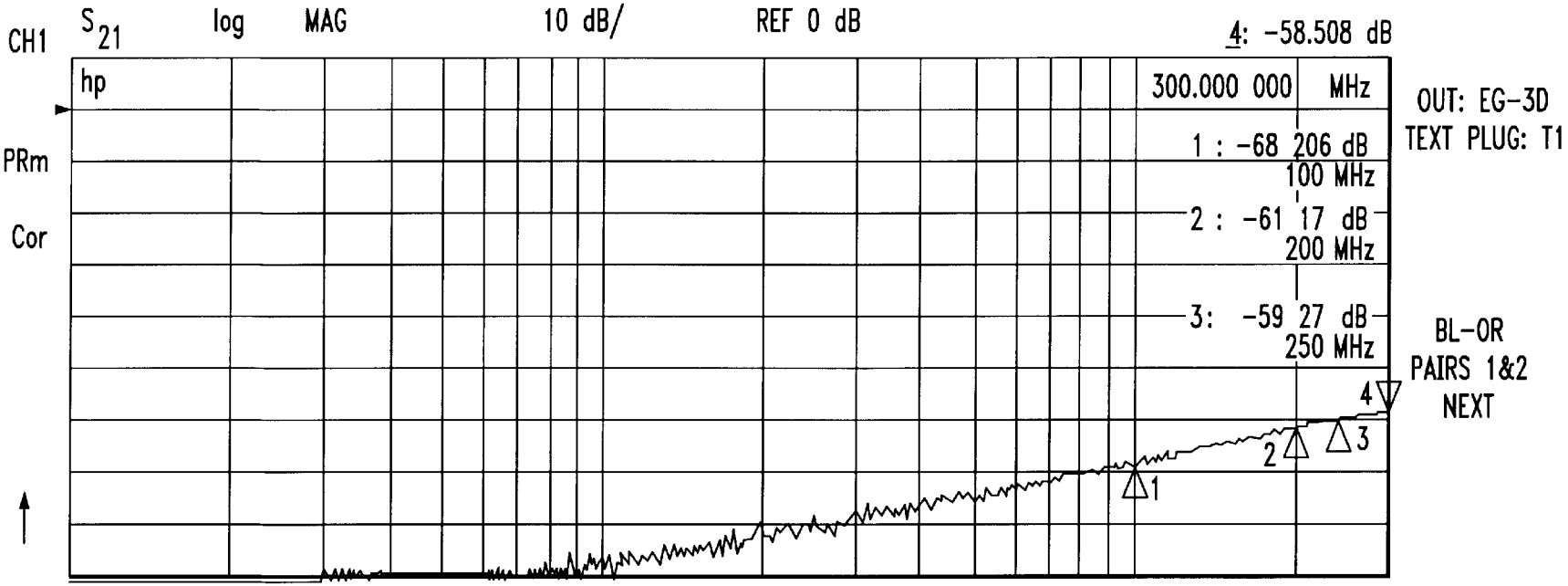
FIGS. 8–13 show near end crosstalk data measured between pairs of terminals of a plug mating with the communications connector assembly.

FIG. 8 shows measured near end crosstalk between plug terminal pairs 1 and 2. The plot in FIG. 8 shows the following results:

| Frequency | Relative Crosstalk (dB) |
|---|---|
| 100 MHz | −68.206 |
| 200 MHz | −61.171 |
| 250 MHz | −59.271 |

Figure 9:
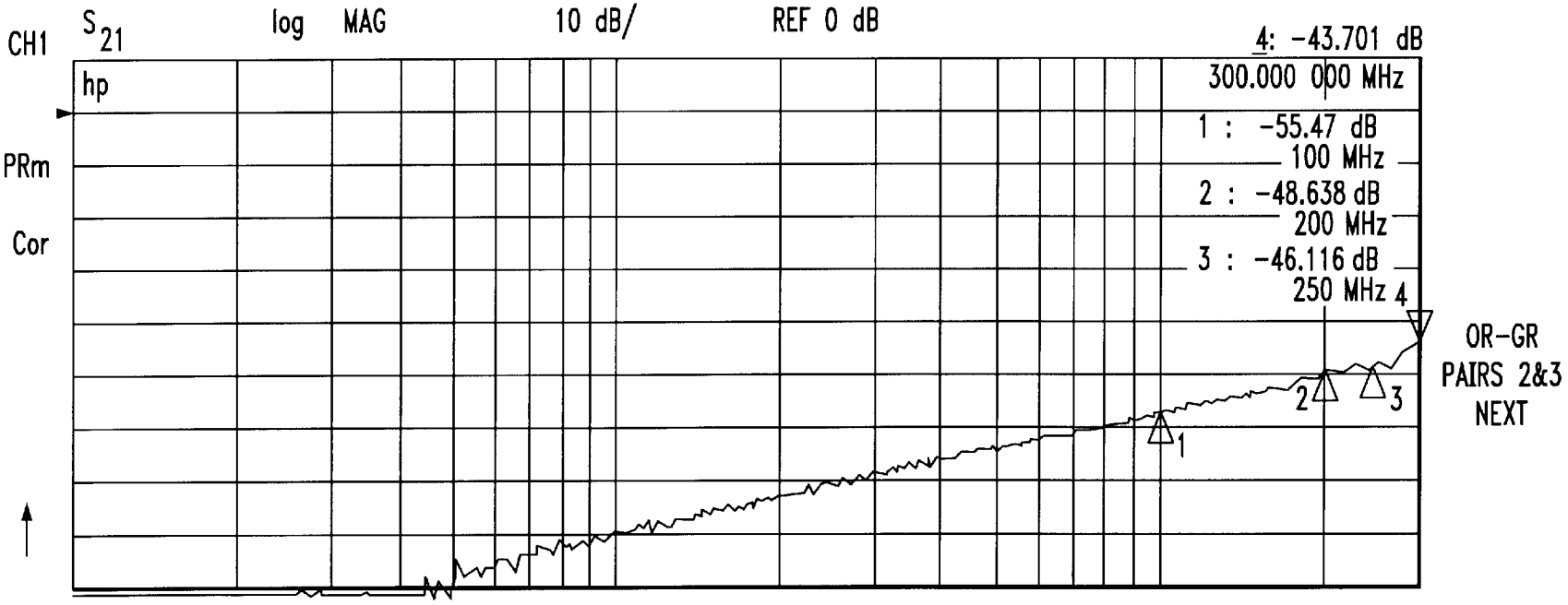

FIG. 9 shows the network analyzer plot of near end crosstalk measured at the inputs of plug terminal pairs 2 and 3. The results are as follows:

| Frequency | Relative Crosstalk (dB) |
|---|---|
| 100 MHz | −55.47 |
| 200 MHz | −48.638 |
| 250 MHz | −46.116 |

Figure 10:
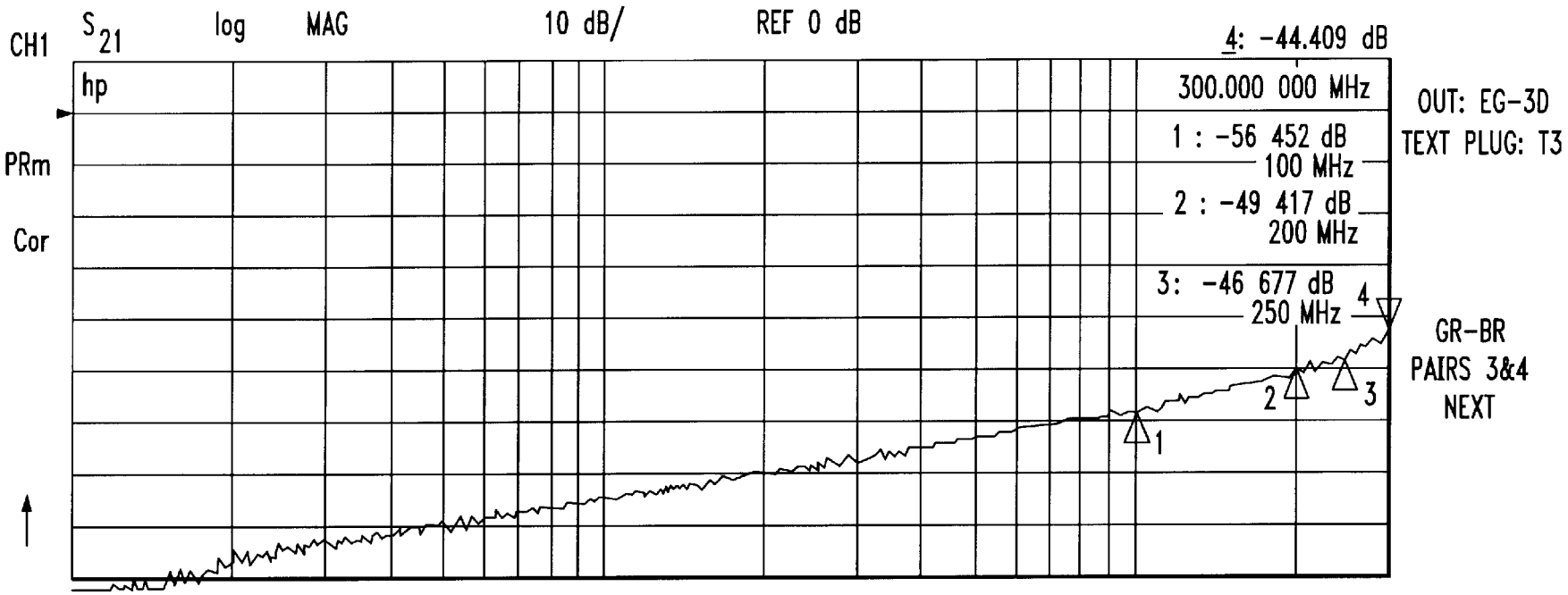

FIG. 10 shows the network analyzer plot of near end crosstalk measured at the plug terminal pairs 3 and 4, with the following results:

| Frequency | Relative Crosstalk (dB) |
|---|---|
| 100 MHz | −56.452 |
| 200 MHz | −49.417 |
| 250 MHz | −46.677 |

Figure 11:
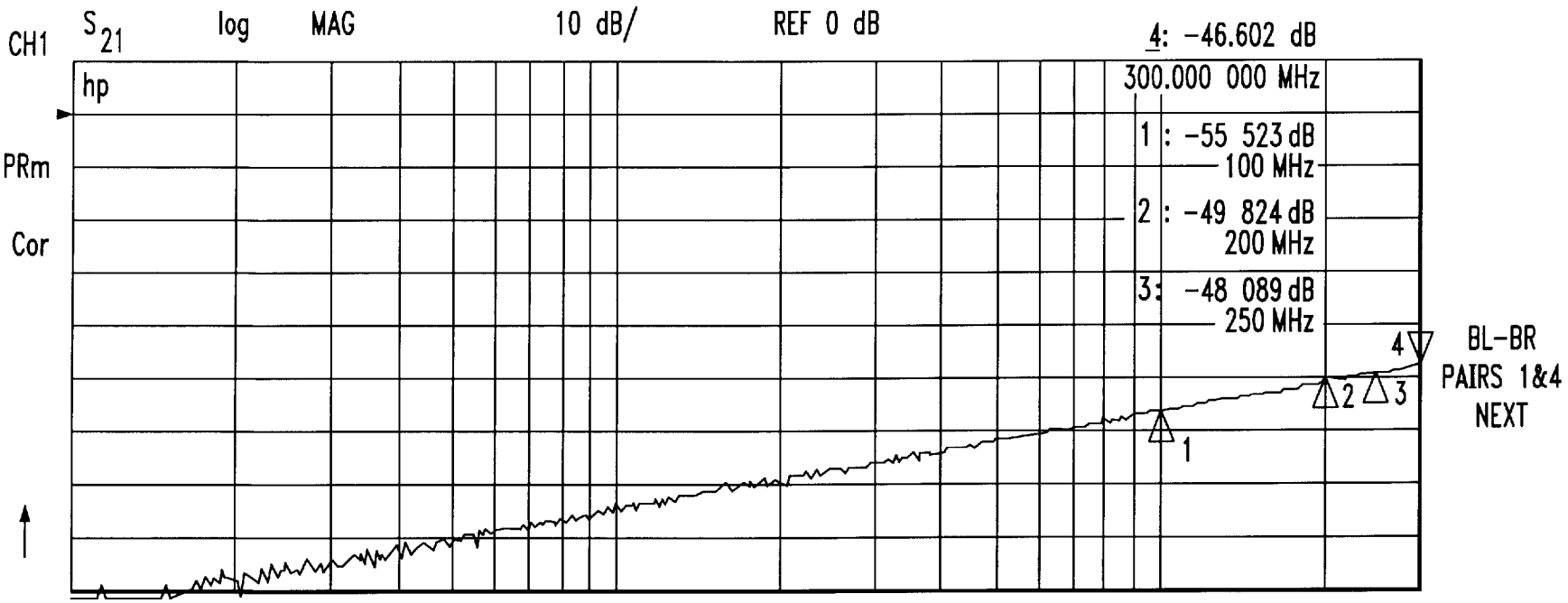

FIG. 11 shows measured near end crosstalk between plug terminal pairs 1 and 4, with the following results:

| Frequency | Relative Crosstalk (dB) |
|---|---|
| 100 MHz | −55.523 |
| 200 MHz | −49.824 |
| 250 MHz | −48.089 |

Figure 12:
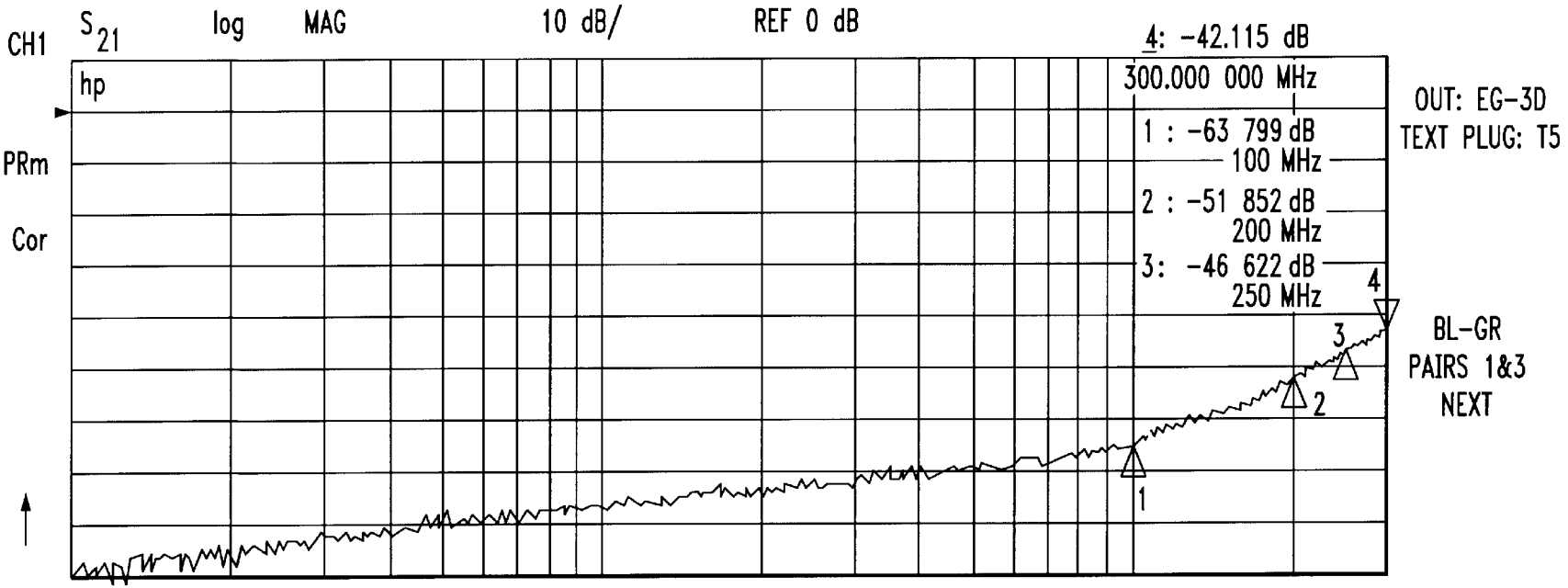

FIG. 12 shows near end crosstalk measured between plug terminal pairs 1 and 3. The results are as follows:

| Frequency | Relative Crosstalk (dB) |
|---|---|
| 100 MHz | −63.799 |
| 200 MHz | −51.852 |
| 250 MHz | −46.622 |

Figure 13:
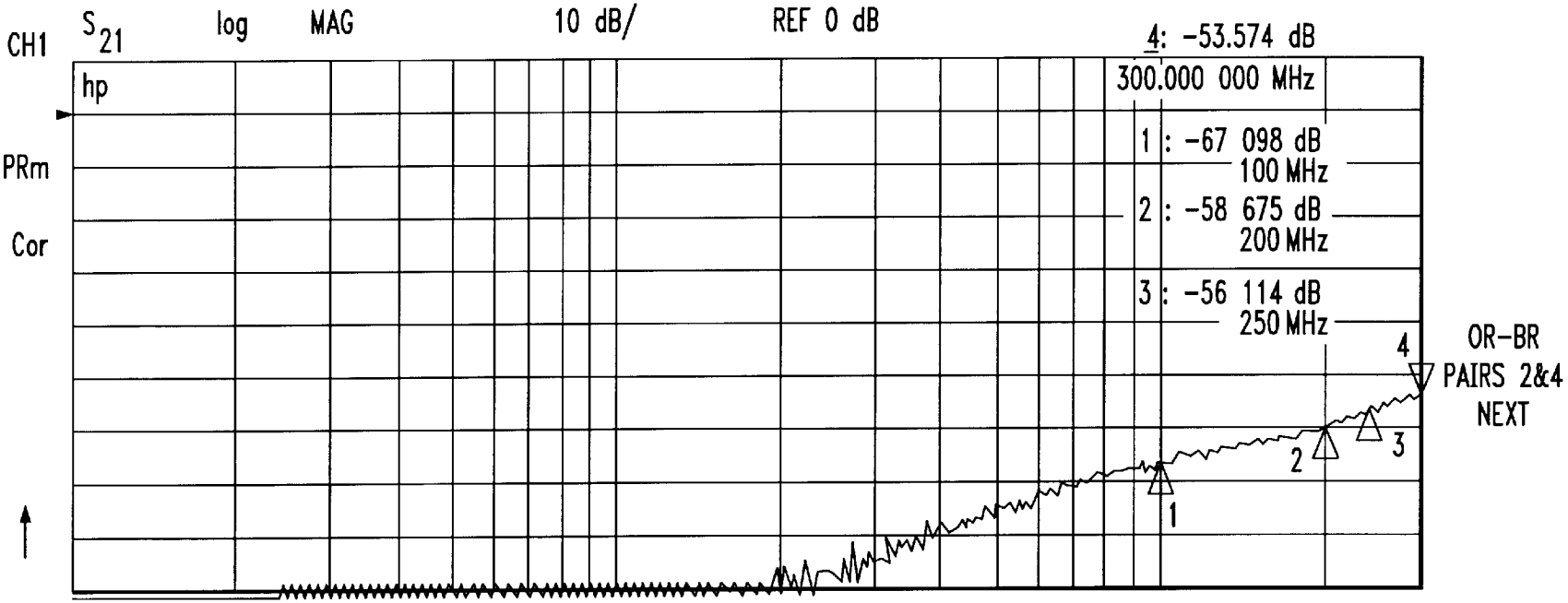

FIG. 13 shows near end crosstalk measured between plug terminal pairs 2 and 4, with the following results:

| Frequency | Relative Crosstalk (dB) |
|---|---|
| 100 MHz | −67.098 |
| 200 MHz | −58.675 |
| 250 MHz | −56.114 |

Category 6 performance calls for at least 46 dB crosstalk isolation at 250 MHz; 48 dB isolation at 200 MHz; and 54 dB isolation at 100 MHz. These levels were fully met in all of the plots of FIGS. 8–13.

While the foregoing description represents a preferred embodiment of the invention, it will be obvious to those skilled in the art that various changes and modifications may be made, without departing from the spirit and scope of the invention pointed out by the following claims.

We claim:

1. A communications connector assembly, comprising:

a wire board having a front portion with a front edge, and a central portion adjacent the front portion;

a number of elongated terminal contact wires each having a base portion connected at one end to the central portion of the wire board, and a free end portion opposite said base portion for making electrical contact with a mating connector;

wherein the terminal contact wires are formed to extend substantially parallel and co-planar with one another and are generally uniformly spaced a certain distance above the front portion of the board, and the free end portions of the terminal contact wires are supported above the front edge of the front portion of the board in cantilever fashion by the base portions of the terminal contact wires so that the free end portions are deflected resiliently in the direction of the board when the mating connector engages the free end portions in a direction substantially parallel to the wire board; and a crosstalk compensating device associated with at least one of the terminal contact wires at a position where the terminal contact wires are co-planar with one another.

2. A communications connector assembly according to claim 1, wherein said crosstalk compensating device includes at least one pair of adjacent terminal contact wires that are formed with opposed cross-over sections next to the free end portions of the adjacent wires.

3. A communications connector assembly according to claim 2, wherein two pairs of adjacent terminal contact wires are formed with said opposed cross-over sections, and a single terminal contact wire extends between the two pair of contact wires in which the cross-over sections are formed.

4. A communications connector assembly according to claim 2, wherein portions of the pairs of terminal contact wires formed with said cross-over sections are operative to produce inductive crosstalk to compensate for crosstalk produced when the free end portions of the terminal contact wires are engaged by the mating connector.

5. A communications connector assembly according to claim 1, wherein said crosstalk compensating device includes at least one dielectric block piece at least partly surrounding one of said terminal contact wires, said block piece having such electrical properties as to produce capacitive crosstalk to compensate for crosstalk produced when the free end portions of the terminal contact wires are engaged by said mating connector.

6. A communications connector assembly according to claim 1, wherein the wire board includes a guide bar disposed near the front edge of the board, said guide bar having guide ways configured to receive the free end portions of the terminal contact wires and to guide said wires for deflecting movement when the mating connector engages said free end portions.

7. A communications jack connector, comprising:

a jack housing having a front surface and a plug opening in said front surface, the plug opening having an axis and being dimensioned for receiving a mating plug connector; and a communications connector assembly inserted in said jack housing for electrically contacting said mating plug connector when the plug connector is inserted in the plug opening along said axis in the jack housing, said connector assembly comprising;

a wire board having a front portion with a front edge, and a central portion adjacent the front portion, and said front portion is supported in the jack housing substantially parallel to the axis of the plug opening;

a number of elongated terminal contact wires each having a base portion connected at one end to the central portion of the wire board, and a free end portion opposite said base portion for making electrical contact with the mating plug connector;

wherein the terminal contact wires are formed to extend substantially parallel and co-planar with one another and are generally uniformly spaced a certain distance above the front portion of the board, and the free end portions of the terminal contact wires are supported above the front edge of the front portion of the board in cantilever fashion by the base portions of the terminal contact wires so that the free end portions are deflected resiliently in the direction of the board when the mating plug connector is received in said plug opening and engages the free end portions along the direction of the axis of the plug opening; and a crosstalk compensating device associated with at least one of the terminal contact wires at a position where the terminal contact wires are co-planar with one another.

8. A communications jack connector according to claim 7, wherein said crosstalk compensating device includes at least one pair of adjacent terminal contact wires that are formed with opposed cross-over sections next to the free end portions of the adjacent wires.

9. A communications jack connector according to claim 8, wherein two pairs of adjacent terminal contact wires are formed with said opposed cross-over sections, and a single terminal contact wire extends between the two pair of contact wires in which the cross-over sections are formed.

10. A communications jack connector according to claim 8, wherein portions of the pairs of terminal contact wires formed with said cross-over sections are operative to produce inductive crosstalk to compensate for crosstalk produced when the free end portions of the terminal contact wires are engaged by the mating connector.

11. A communications jack connector according to claim 7, wherein said crosstalk compensating device includes at least one dielectric block piece at least partly surrounding one of said terminal contact wires, said block piece having such electrical properties as to produce capacitive crosstalk to compensate for crosstalk produced when the free end portions of the terminal contact wires are engaged by said mating connector.

12. A communications jack connector according to claim 7, wherein the wire board includes a guide bar disposed near the front edge of the board, said guide bar having guide ways configured to receive the free end portions of the terminal contact wires and to guide said wires for deflecting movement when the mating connector engages said free end portions.

13. A communications jack connector, comprising:

a jack housing having a front surface and a plug opening in said front surface, the plug opening having an axis and being dimensioned for receiving a mating plug connector; and a communications connector assembly inserted in said jack housing for electrically contacting said mating plug connector when the plug connector is inserted in the plug opening along said axis in the jack housing, said connector assembly comprising;

a wire board having a front portion with a front edge, and a central portion adjacent the front portion, and said front portion is supported in the jack housing substantially parallel to the axis of the plug opening;

a number of elongated terminal contact wires each having a base portion connected at one end to the central portion of the wire board, and a free end portion opposite said base portion for making electrical contact with the mating plug connector;

wherein the terminal contact wires are formed to extend substantially parallel and co-planar with one another and are generally uniformly spaced a certain distance above the front portion of the board, and the free end portions of the terminal contact wires are supported above the front edge of the front portion of the board in cantilever fashion by the base portions of the terminal contact wires so that the free end portions are deflected resiliently in the direction of the board when the mating plug connector is received in said plug opening and engages the free end portions along the direction of the axis of the plug opening; and a member inside said jack housing which member is formed and located to apply a pre-load force at ends of the terminal contact wires, so that a specified contact force is established along a line of contact on the free end portions of the wires when the mating plug connector engages the free end portions.

14. A communications jack connector according to claim 13, wherein said member comprises a shelf having a stop surface, and the ends of the terminal contact wires abut said stop surface with said pre-load force.

15. A communications jack connector according to claim 13, including a crosstalk compensating device associated with at least one of the terminal contact wires at a position where the terminal contact wires are co-planar with one another.

* * * * *